US005320418A

United States Patent [19]

Chen

[11] Patent Number: 5,320,418

[45] Date of Patent: Jun. 14, 1994

[54] SKATE WHEEL STRUCTURE

[75] Inventor: Ting-Hsing Chen, Tainan, Taiwan

[73] Assignee: Far Great Plastics Ind'l Co., Ltd., Tainan, Taiwan

[21] Appl. No.: 45,123

[22] Filed: Apr. 12, 1993

[51] Int. Cl.[5] ..... B60B 5/02

[52] U.S. Cl. ..... 301/5.3; 301/64.7; 152/323; 280/11.23

[58] Field of Search ..... 301/5.3, 5.7, 64.7; 152/323; 280/11.22, 11.23, 11.19

[56] References Cited

U.S. PATENT DOCUMENTS 4,095,846 6/1978 Agins ..... 152/323 X
4,592,595 6/1986 Freeman ..... 301/64.7
4,818,034 4/1989 Djerf ..... 301/64.7
5,048,848 9/1991 Olson et al. ..... 280/11.22

*Primary Examiner*—Stormer Russell D.
*Attorney, Agent, or Firm*—Morton J. Rosenberg; David I. Klein

[57] ABSTRACT

This invention provides for a skate wheel structure including an outer arcuate shell (1) molded to an inner barrel (2). The outer arcuate shell (1) includes a series of spaced apart arcuate shell segments (20) which are joined each to the other by bridge members (5). The bridge members (5) have a contour which provides for an upper recess (6) and an internal opening or groove (3) formed below the bridge element (5). A plastic tire (4) is molded into the recess (6) and the groove (3) for securing the plastic tire (4) to the outer arcuate shell (1).

1 Claim, 4 Drawing Sheets

SKATE WHEEL STRUCTURE

BACKGROUND OF THE INVENTION

1. Field of the Invention

This invention broadly relates to a skate wheel. More in particular, the invention relates to a wheel rim which has bridge elements equally spaced on an outer shell between shell segments to eliminate the possibility of shrinkage of the plastic material during and after manufacture.

2. Prior Art

Roller skating has become a popular sport in recent times and is more convenient and less restrictive when compared to ice skating. In order to acquire the best performance and to maintain a high stability, wheels must be maintained in excellent working order. In prior art systems, the contour of the plastic tires 44 as shown in FIG. 7 has been found to deform under certain conditions. Such deformation of the wheel contour jeopardizes the user's safety.

It is therefore, a major consideration of the subject skate wheel structure to eliminate the above-mentioned shortcomings.

SUMMARY OF THE INVENTION

It is a primary object of the present invention to provide a skate wheel structure which prevents a tire mounted thereon from shrinkage.

It is another object of the present invention to provide a skate wheel structure which is safe for user operation.

It is a further object of the present invention to provide a skate wheel structure which maintains a stabilized contour after extended periods of operation.

DETAILED DESCRIPTION OF THE PREFERRED EMBODIMENTS

Figure 1:
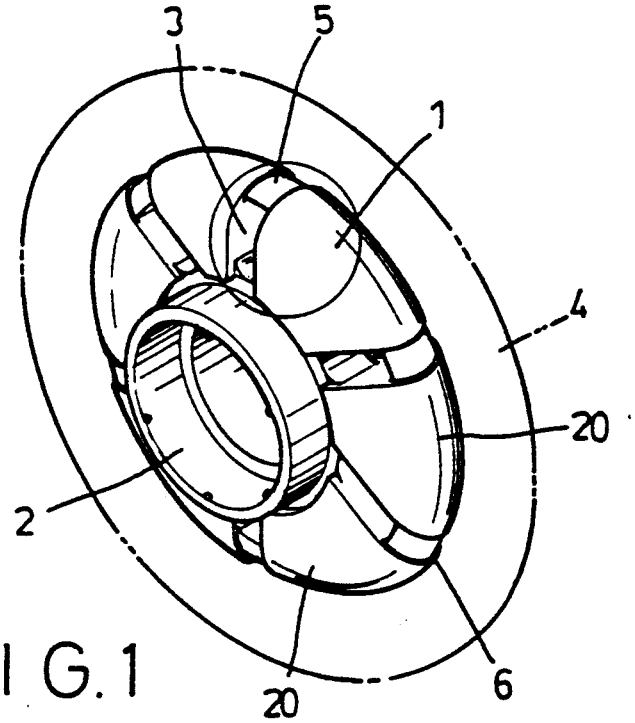
FIG. 1 is a perspective view showing the skate wheel structure of the present invention concept.

Referring now to FIG. 1, there is shown a skate wheel including an outer arcuate shell 1 defining a plurality of spaced apart shell segments 20. An inner barrel 2 is integrally formed to and at the center of outer shell 1. The outer shell 1 is formed having a plurality of internal openings 3 formed between consecutively spaced shell segments 20 for dividing the outer shell 1 into spaced apart segments 20 as shown.

Figure 2:
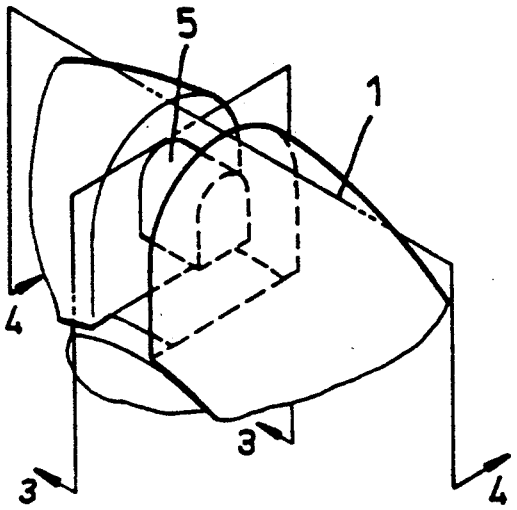
FIG. 2 is an enlarged perspective partially cut-away view of a portion of FIG. 1.
Figure 3:
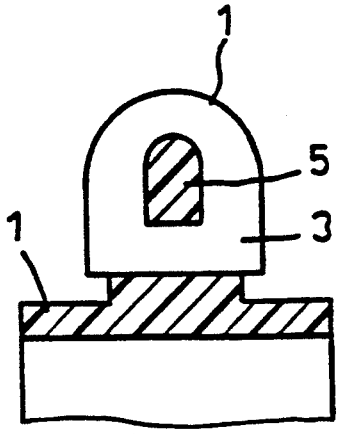
FIG. 3 is a front cross-sectional view of the skate wheel structure taken along the section line 3—3 of FIG. 2.
Figure 4:
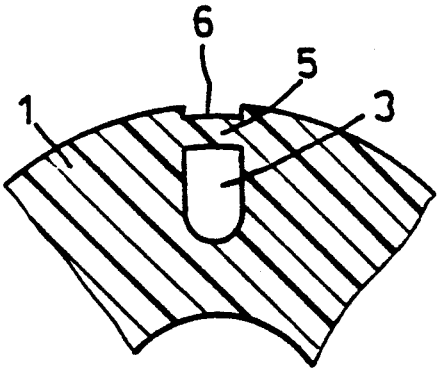
FIG. 4 is a front cross-sectional view of the skate wheel structure taken along the section line 4—4 of FIG. 2.
Figure 5:
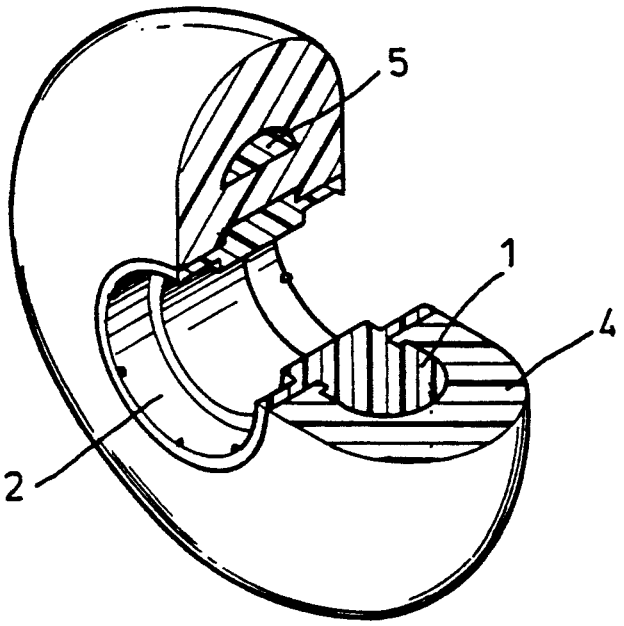
FIG. 5 is a perspective partially sectioned view of the present invention embraced by a tire.

A plurality of bridge elements 5 are mounted in the grooves 3 connecting the outer shell 1 as shown in FIG. 2. The bridge elements 5 are coupled and molded on opposing ends to consecutively spaced shell segments 20. Bridge elements 5 are contoured in cross-section to be smaller than an outer periphery of respective segments 20 to provide the recesses 6 and the internal openings or grooves 3 as shown. The openings 3 and recesses 6 are filled with plastic material when the tire 4 is molded to the outer shell 1 and the inner barrel 2 as shown in FIGS. 3 and 4. Curves or recesses 6 are formed on the surface of each groove 3 for guiding plastic material to flow within and along the curves 6 into the grooves 3 when molding as shown in FIG. 5.

Figure 6:
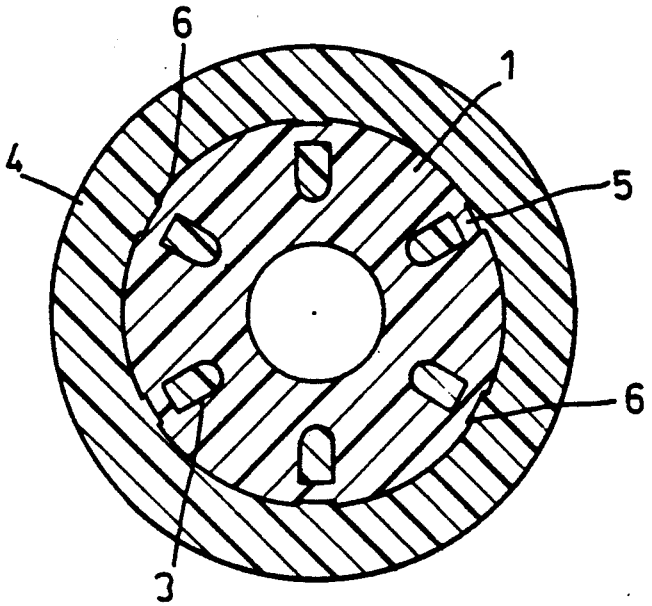
FIG. 6 is a cross-sectional side elevational view of FIG. 5.
Figure 7:
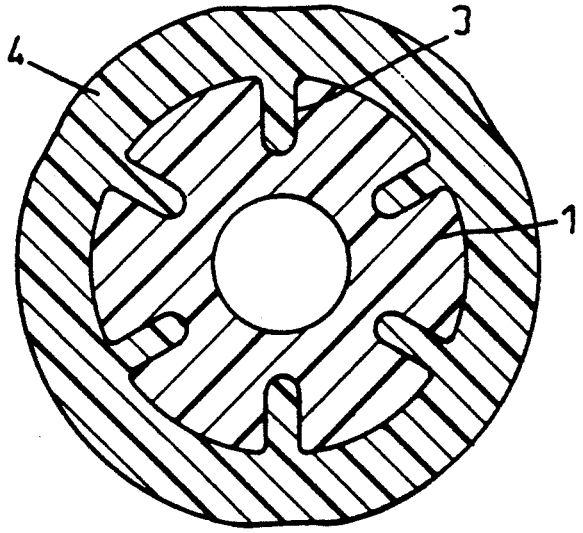
FIG. 7 PRIOR ART
FIG. 7 is a cross-sectional view of a prior art skate wheel structure.

When the molding process has been completed, the plastic attaches to the outer shell 1 as well as within the openings 3 in a firm manner with the openings or grooves 3 also preventing plastic shrinkage as shown in FIG. 6.

I claim:

1. A skate wheel structure having an inner barrel comprising:

(a) an outer arcuate shell molded to said inner barrel, said outer arcuate shell defining a plurality of spaced apart outer arcuate shell segments, consecutively spaced ones of said spaced apart outer shell segments being moldedly coupled each to the other by an intermediate bridge member coupled on opposing ends thereof to said consecutively spaced ones of said spaced apart outer arcuate shell segments, said bridge member being formed within an outer surface contour of said spaced apart outer shell segments to form a recess between said bridge element and an outer surface of said shell segments and an internal opening below said bridge element; and, (b) a plastic tire molded into said recess and said internal opening for securing said plastic tire to said outer arcuate shell.

* * * * *